US007063042B2

(12) United States Patent
Dillingham

(10) Patent No.: US 7,063,042 B2
(45) Date of Patent: Jun. 20, 2006

(54) CONTINUOUS GEAR HINGE WITH ELECTRICAL CONDUCTOR

(75) Inventor: Matthew R. Dillingham, Talladega, AL (US)

(73) Assignee: C. Hager & Sons Hinge Manufacturing Co., St. Louis, MO (US)

( * ) Notice: Subject to any disclaimer, the term of this patent is extended or adjusted under 35 U.S.C. 154(b) by 57 days.

(21) Appl. No.: 10/698,641

(22) Filed: Oct. 31, 2003

(65) Prior Publication Data

US 2005/0091797 A1 May 5, 2005

(51) Int. Cl.
*E05D 7/00* (2006.01)

(52) U.S. Cl. ..... 116/354; 16/387; 160/229.1

(58) Field of Classification Search ..... 16/354, 16/342, 366, 321, 387; 174/35 MS, 35 R; 312/326; 160/229.1; 361/681–683
See application file for complete search history.

(56) References Cited

U.S. PATENT DOCUMENTS

| | | | | |
|---|---|---|---|---|
| 2,778,000 | A | 1/1957 | Mills | |
| 3,048,806 | A | 8/1962 | Heidler | |
| 3,132,911 | A * | 5/1964 | Heidler | 439/31 |
| 3,402,422 | A * | 9/1968 | Baer | 16/366 |
| 3,818,122 | A | 6/1974 | Luetzow | |
| 3,860,312 | A | 1/1975 | Gordon, Jr. | |
| 4,066,857 | A * | 1/1978 | Suska | 200/61.7 |
| 4,140,357 | A | 2/1979 | Wolz et al. | |
| 4,885,430 | A | 12/1989 | Kinser, Jr. et al. | |
| 4,961,126 | A | 10/1990 | Suzuki | |
| 5,001,810 | A * | 3/1991 | Baer | 16/302 |
| 5,027,394 | A | 6/1991 | Ono et al. | |
| 5,141,446 | A * | 8/1992 | Ozouf et al. | 439/165 |
| 5,201,902 | A * | 4/1993 | Baer | 16/354 |
| 5,337,451 | A * | 8/1994 | Goossens | 16/354 |
| 5,363,089 | A * | 11/1994 | Goldenberg | 340/7.63 |

(Continued)

OTHER PUBLICATIONS

Hager, Instructions ROTON Hinge With ETW, "Door and Frame Preparation for 4-, 6-, 8- and 10- Wire ETW (Electrice Through Wire) Hinges for 1/3/4" Doors, Rev. Jan. 3, 2003.

*Primary Examiner*—Brian E. Glessner
*Assistant Examiner*—Mark Williams
(74) *Attorney, Agent, or Firm*—Polster, Lieder, Woodruff & Lucchesi, L.C.

(57) ABSTRACT

A continuous gear hinge has leaves provided with meshing gear segments and a cap that extends over and behind the gear segments for holding the segments together while allowing one leaf to pivot relative to the other leaf. Each leaf has a cutout which interrupts its gear segment. The cutouts receive a conductor assembly including pivot members which likewise have meshing gear segments and an electrical conductor attached to the two pivot members and extended through the cap where it is obscured and rendered inaccessible by the cap itself and by the meshing gear segments of the pivot members. The ends of the gear segments for the leaves, at the cutouts, are spaced from the ends of the gear segments on the pivot members to provide pockets, and these pockets receive bearing blocks which prevent longitudinal displacement of one leaf relative to the other leaf.

19 Claims, 6 Drawing Sheets

U.S. PATENT DOCUMENTS 5,428,350 A 6/1995 Kurcbart et al.
5,581,440 A 12/1996 Toedter
5,681,176 A 10/1997 Ibaraki et al.
5,727,960 A * 3/1998 Zehrung ..... 439/165
5,987,704 A * 11/1999 Tang ..... 16/354
6,073,310 A * 6/2000 Baer ..... 16/354
6,079,993 A * 6/2000 Laine ..... 439/165
2001/0001749 A1 5/2001 Andrews et al.

* cited by examiner

CONTINUOUS GEAR HINGE WITH ELECTRICAL CONDUCTOR

CROSS REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The invention relates in general to gear hinges and, more particularly to a gear hinge that contains an electrical conductor so that an electrical circuit may be completed through the hinge.

Continuous gear hinges will tolerate considerably more abuse than more traditional knuckle hinges and for that reason are found on doors which see substantial use, such as those at the main entrances to schools and public buildings, often as replacements for knuckle hinges. The typical gear hinge has two leaves, each provided with a gear segment. The gear segments of the two leaves mesh while being held together with a cap that extends over and behind them. The one leaf is attached to the door that the hinge supports while the other is secured to the hinge jamb of the door frame out of which the door opens. Both leaves extend the full length of the door, thus providing multiple locations at which to attach the hinge to the door and hinge jamb. Knuckle-type hinges, on the contrary, secure the door to the hinge jamb at small isolated areas, and may pull away from one or the other or both, particularly when used on doors that see heavy or abusive use.

More and more doors carry electrically-operated appliances such as locks or sensors, and these appliances require electrical service in the doors themselves. And this holds particularly true for the very same doors on which continuous gear hinges are well-suited. A variety of designs exist for transferring electricity through knuckle hinges. In this regard, see U.S. Pat. Nos. 3,838,234; 3,842,386; and 4,412,711. However, continuous gear hinges have seen little innovation in this respect.

SUMMARY OF THE INVENTION

The present invention resides in a gear hinge having leaves provided with meshing gear segment and a cap which extends over and behind the gear segments to prevent them from separating while enabling one to pivot relative to the other. Each leaf has a pivot member, and the pivot members cooperate to obscure the interior of the cap behind the pivot members. An electrical conductor extends from one pivot member to the other and between the two pivot members passes through the cap.

DETAILED DESCRIPTION

Figure 1:
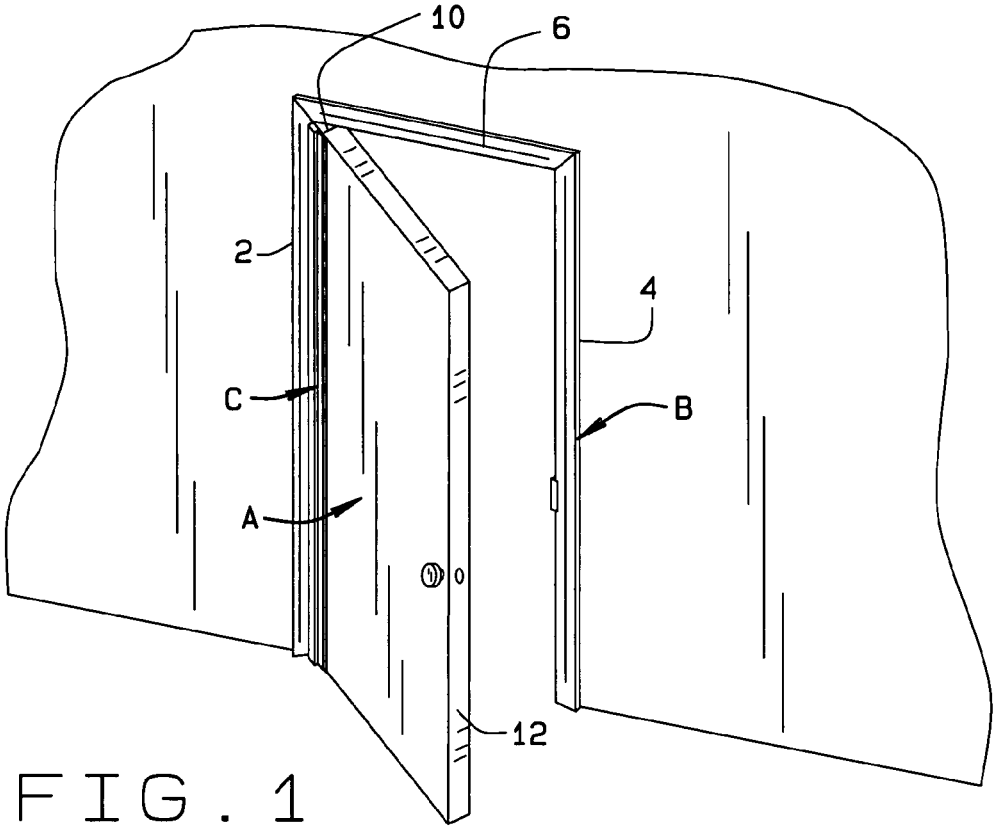
FIG. 1 is a perspective view of a door supported on a door frame with a hinge constructed in accordance with and embodying the present invention.

Referring now to the drawings, a door A swings into and out of a door frame B on a continuous gear hinge C (FIG. 1). The door A contains an appliance that relies on electricity for its operation, and that electricity is delivered through the continuous gear hinge C.

Figure 2:
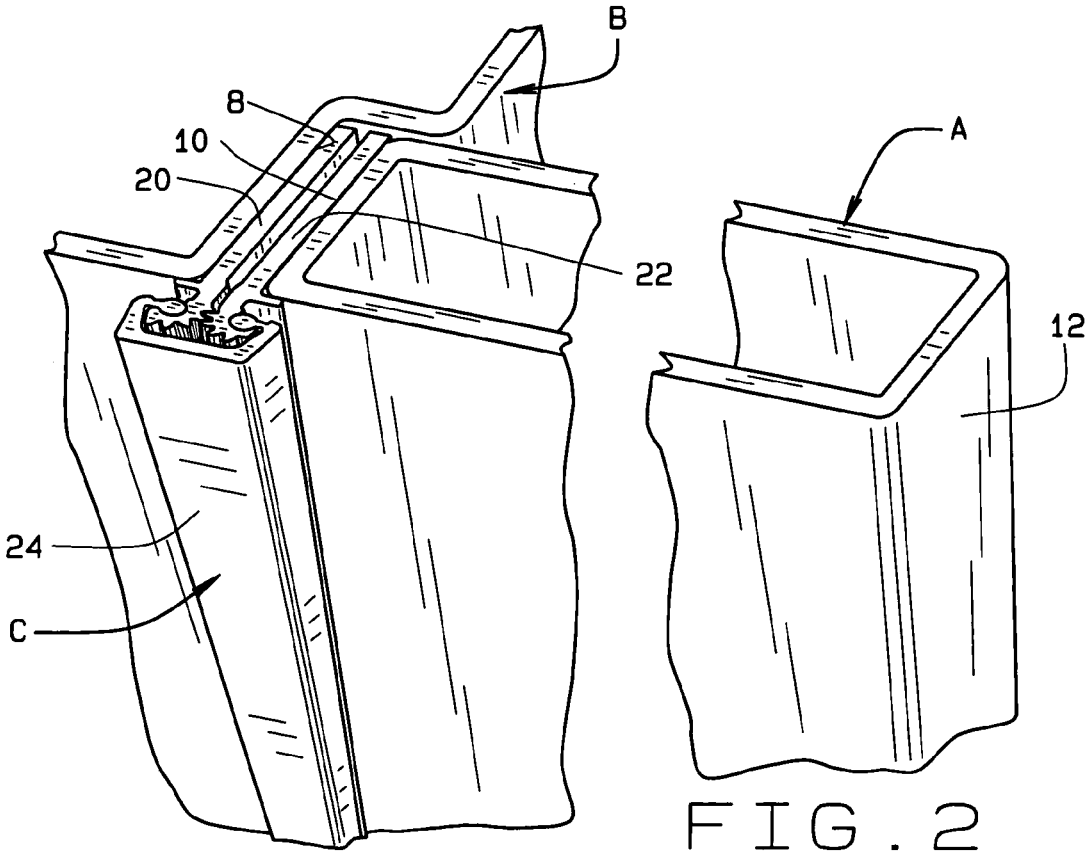
FIG. 2 is a fragmentary perspective view of the door frame, door and hinge, with the door and hinge closed.

Considering the door frame B in more detail, it includes (FIGS. 1 & 2) a hinge jamb 2 on its one side, a strike jamb 4 on its other side, and a lintel 6 extended between the upper ends of the two jambs 2 and 4. The hinge jamb 2 has a vertical mounting surface 8 which is presented toward the strike jamb 4. With regard to the door A, it has vertical edges 10 and 12, the former, when the door A is closed, lies along the vertical surface 8 of the hinge jamb 2 and the latter along the strike jamb 4. The hinge C is attached to the door frame B along the mounting surface 8 of the hinge jamb 2 and to the door A along its edge 10.

The continuous gear hinge C extends essentially the full length of the hinge jamb 2 and door edge 10. It includes (FIGS. 2 & 3) jamb leaf 20 which is attached to the hinge jamb 2, a door leaf 22 which is attached to the door A, a cap 24 for preventing the two leaves 20 and 22 from separating while still enabling them to pivot, and bearing blocks 26 which prevent the leaf 22 from shifting longitudinally relative to the leaf 20. In addition, it has a conductor assembly 30 which enables an electric circuit to pass through the hinge C.

Figure 3:
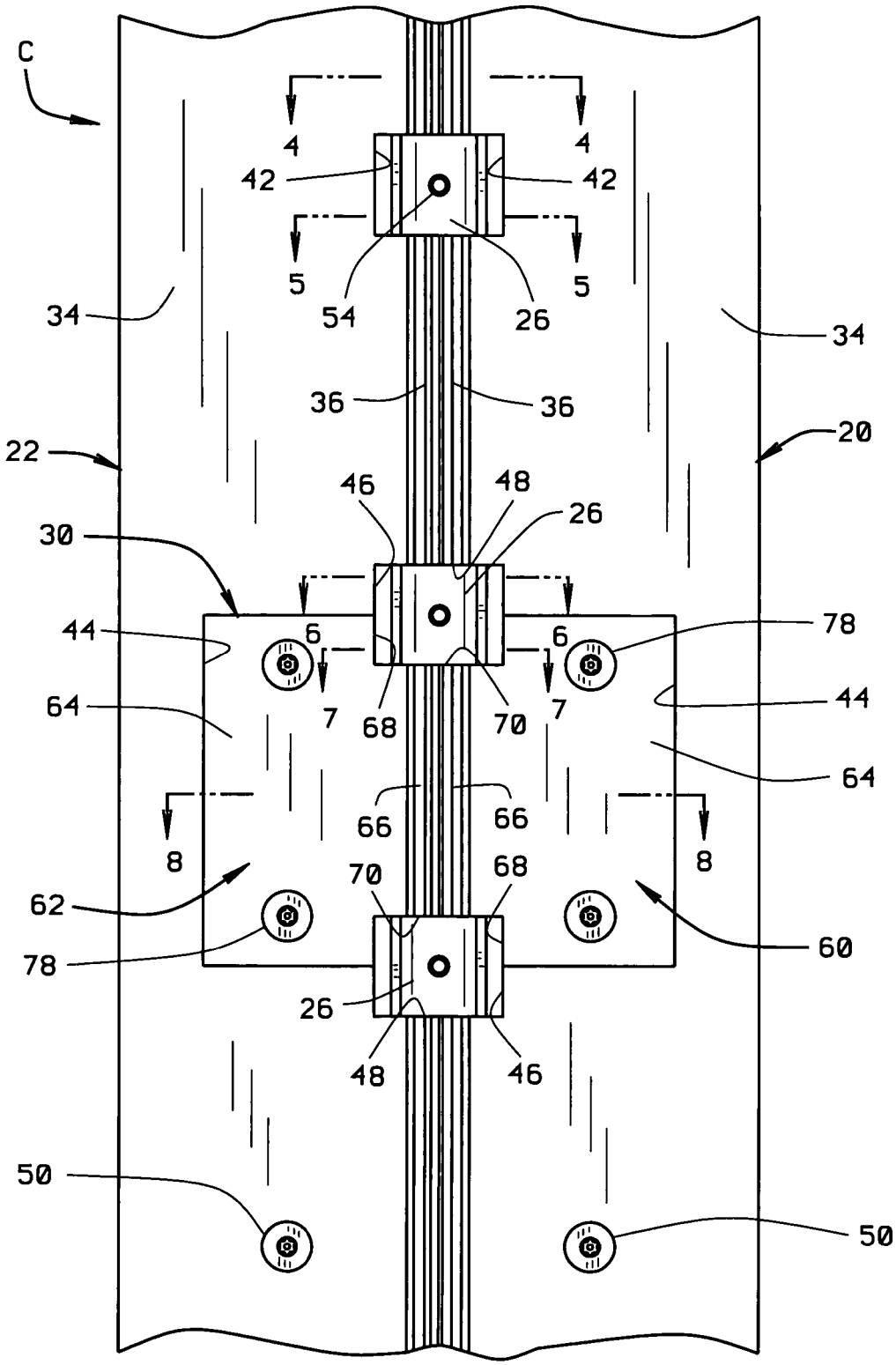
FIG. 3 is a front elevational view of a fragment of the hinge in its open position.
Figure 4:
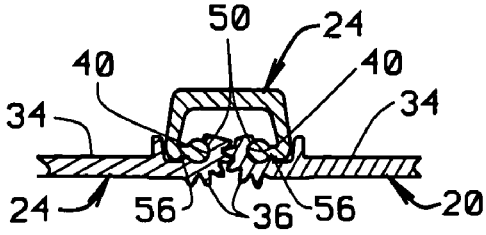
FIGS. 4, 5, 6, 7 and 8 are sectional views taken along lines 4—4, 5—5, 6—6, 7—7 and 8—8, respectively, of FIG. 3.

Each leaf 20 and 22 includes (FIG. 3) a plate 34 and a gear segment 36 formed integral with the plate 34 along one side of the plate 34. The gear segment 36 has teeth and contains a bearing surface 40 (FIG. 4) of generally semi-cylindrical configuration which opens away from the teeth. Each leaf 20 and 22 also has several pockets 42 which interrupt its gear segment 36 completely and further extend slightly into the adjoining region of the plate 34. Finally, each leaf 20 and 22 has a cutout 44 (FIG. 9) of generally rectangular shape that extends well into the plate 34 and also interrupts its gear segment 36 to a much greater extent than the pockets 42. Indeed, where a cutout 44 opens out of each gear segment 36, it has offsets 46 which give the cutout 44 even greater length along the gear segment 36. The offsets 46 create bearing surfaces 48 (FIG. 3).

The leaf 20 is attached to the door frame B with its plate 34 against the vertical mounting surface 8 of the hinge jamb 2, it being secured by screws 50 (FIG. 3) which pass through the plate 34 and into the hinge jamb 2. The leaf 22 is attached to the door A with its plate 34 against the vertical edge 10, it being secured with more screws 50 that pass through the plate 34 and into the edge 10.

The gear segments 36 of the two leaves 20 and 22 mesh, with the pockets 42 of the two leaves 20 and 22 being aligned and likewise with the larger cutouts 44 being aligned. Moreover, the semi-cylindrical bearing surface 40 in the gear segment 36 of the two leaves 20 and 24 open away from each other (FIG. 4), and this holds true irrespective of the angular relationship between the two leaves 20 and 22.

The bearing blocks 26 fit into the aligned pockets 42 with the ends against the ends of the gear segments 66 at the pockets 42 and thus prevent the leaves 20 and 22 from shifting longitudinally with respect to each other. Each bearing block 26 along its sides has channels 52 which align with the semi-cylindrical bearing surfaces 40 in the meshed gear segments 36. Moreover, some of the bearing blocks 26 contain set screws 54 (FIG. 3) which pass laterally through them between the channels 52 along their sides.

Figure 5:
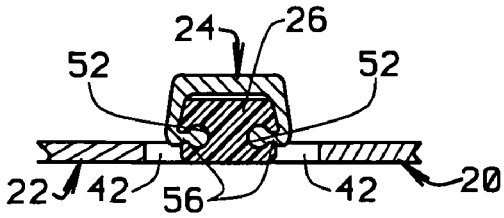
Figure 6:
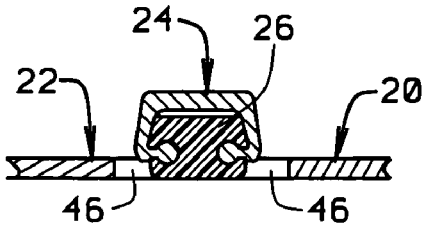
Figure 7:
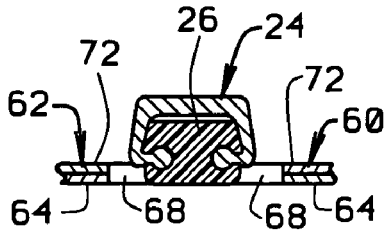
Figure 9:
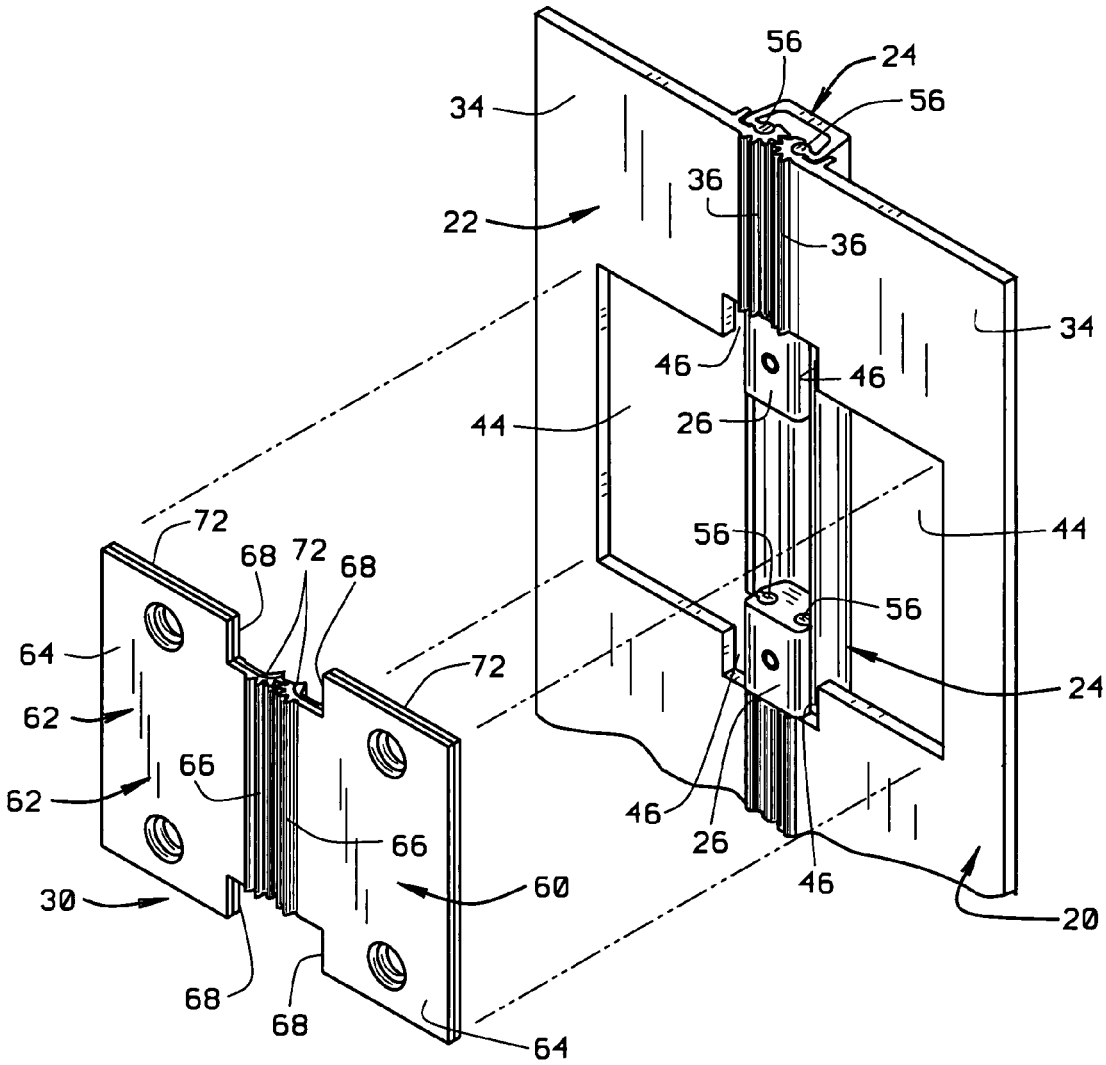
FIG. 9 is a fragmentary exploded perspective view of the leaves and conductor assembly for the hinge.

The cap 24 extends over the gear segments 36 of the two leaves 20 and 22 and for the most part encloses them. It possesses a channel-shaped configuration and has ribs 56 (FIGS. 4 & 5) which project toward each other from the sides of the cap 24. The ribs 56 have cylindrical bearing surfaces 58 which bear against the semi-cylindrical bearing surfaces 40 in the gear segments 36, irrespective of the angular position of the leaves 20 and 22. Thus, the cap 24 prevents the meshed gear segments 36 from separating. The ribs 56 extend axially completely through the pockets 42, but are interrupted by the cutouts 44. Actually, they project though the offsets 46 of the cutouts 44 and somewhat beyond, but not completely through the cutouts 44 (FIGS. 7 & 9). Within the pockets 42, the ribs 56 project into the channels 52 in the sides of the bearing blocks 26, and this retains the bearing blocks 26 in the pockets 42. The set screws 52 in the bearing blocks 26, when turned down, bear against the cap 24 and thus prevent the cap 24 from displacing longitudinally relative to the leaves 20 and 22.

Figure 8:
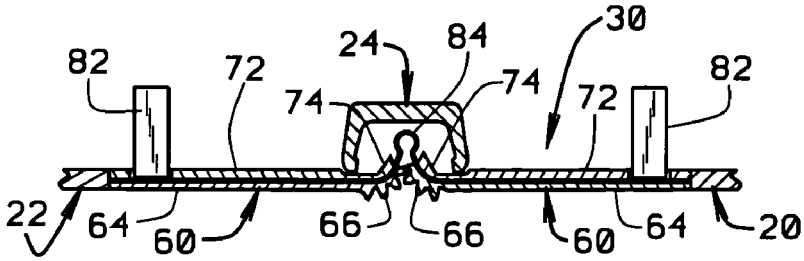
Figure 10:
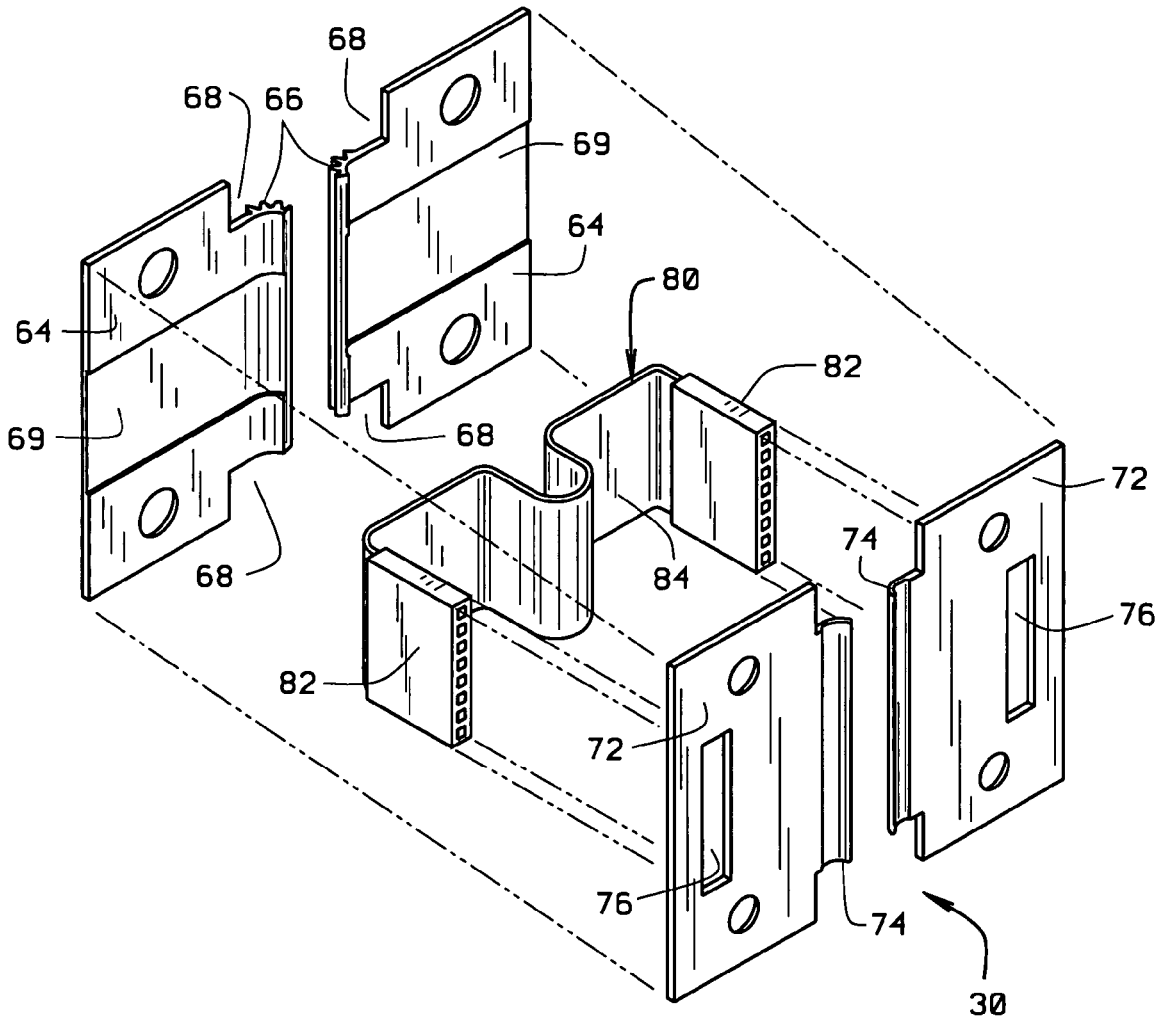
FIG. 10 is an exploded perspective view of the conductor assembly.

The conductor assembly 30 fits into the aligned cutouts 44 in the leaves 20 and 22 along with two more bearing blocks 26 (FIGS. 3 & 9). It includes pivot members 60 and 62 which lie respectively within the cutout 44 of the leaf 20 and the cutout 44 of the leaf 22. Each member 60 and 62 has a face plate 64 provided with a gear segment 66 along one of it edges and an offset 68 at each end of the gear segment 66, thus making the gear segment 66 shorter than the remainder of the face plate 64. The face plate 64 contains a shallow channel 69 which opens out of its back face and extends laterally through it, including through the back of the gear segment 66 (FIG. 10). The gear segments 66 for the two face plates 64 have teeth of the same configuration as the teeth on the gear segment 36 of the leaves 20 and 22. The teeth on the gear segment 66 for the pivot member 60 align with the teeth on the gear segment 36 for the jamb leaf 20, whereas the teeth on the gear segment 66 for the pivot member 62 align with the teeth or the gear segment 36 for the door leaf 22. The gear segments 66 in the two pivot members 60 and 62 likewise mesh (FIGS. 8 & 9). The ends of the gear segments 66 for the face plates 64 of the pivot members 60 and 62 form more bearing surfaces 70, and by reason of the offsets 46 in the cutouts 44 of the leaves 20 and 22 and the offsets 68 in the face plates 64 of the pivot members 60 and 62, the bearing surfaces 70 on the gear segments 66 of the pivot members 60 and 62 are spaced from the bearing surfaces 58 where the gear segments 36 of the leaves 20 and 22 are interrupted. The spacing creates more pockets which open toward each other at both ends of the meshed gear segments 66 on the pivot members 60 and 62. These pockets receive more bearing blocks 26 which together with the bearing blocks 26 in the pockets 42 transfer the weight of the door A to the jamb leaf 20. In addition to its face plate 64, each pivot member 60 and 62 has a backing plate 72 (FIGS. 8 & 10) which is essentially the same configuration as the face plate 64, although the backing plate has a curved lip 74 instead of the gear segment 66. The backing plate 72 lies behind the face plate 64 with its lip 74 behind the gear segment 36 and likewise occupies the cutout 44. It has an elongated aperture 76 slightly inwardly from its side margin that is remote from the gear segment 66 on the face plate 64, and the aperture 76 aligns with the shallow channel 68 in the overlying face plate 64.

The backing plate 72 is attached to the face plate 64 with an adhesive, at least initially, but the two plates 64 and 72 are attached more securely within their cutouts 44 by screws 78 which pass through the plates 64 and 72 and thread into the hinge jamb 2 or door edge 10, whatever the case may be. The heads of the screws 78 are countersunk into the face plate 64 and backing plate 72. When the pivot members 60 and 62 are attached to the jamb 2 and door A, the exposed surfaces of their face plates 64 lie flush with the exposed surfaces of the plates 34 for the two leaves 20 and 22.

The conductor assembly 30 also includes a wiring harness 80 (FIG. 10) having a connector 82 at each of its ends and ribbon-like wire 84 between the two connectors 82. The wire 84, which is highly flexible, contains multiple conductors located side by side, and for each conductor, each connector 82 has a terminal or contact to which the conductor is connected. The ribbon wire 84 passes between the face plate 64 and backing plate 72 of each pivot member 60 and 62 (FIG. 8) where it occupies the shallow channel 69. Between the two pivot members 60 and 62 the wire 84 forms a loop which extends around the gear segments 66 of the two pivot members 60 and 62. Immediately before its ends, the ribbon wire 84 turns rearwardly out of the channels 69 in the face plates of the pivot members 60 and 62 projects into the apertures 76 in the backing plates 72 of those members 60 and 62. Here the connectors 82 are attached to the ribbon wire 84 in the backing plates 72, and, owing to the orientation of the wire 84 in these regions, the connectors 82 generally project rearwardly from the backing plates 72. The connectors 82 behind the pivot member 60 snaps into a connector in the hinge jamb 2 and that connector has wires leading from it. The connector 82 behind the other pivot member 62 snaps into another connector to which wires in the door A lead. Thus, the ribbon wire 84 of the conductor assembly 30 may form a part of several electrical circuits that extend into the door A.

That circuit in the region of the hinge C is totally obscured and inaccessible behind the face plates 64 of the pivot members 60 and 62 at the exposed face of the hinge C and by the cap 24 on the other face. Indeed, when the hinge C is closed, as it is when the door A is closed, even the face plates 64 of the two pivot sections 60 and are obscured and inaccessible. Moreover, when the hinge C—and door A—are open, one can completely remove the conductor assembly 30 to service it or completely replace it. To this end, one removes the screws 78 that attach the pivot sections 60 and 62 to the door jamb 2 and door B and then withdraws the assembly 80 from the aligned cutouts 44 in the leaves 20 and 22. The connectors in the hinge jamb 2 and door A come with it, and, when exposed, they are simply detached from the connectors 82 of the conductor assembly 30. This frees the conductor assembly 30. Installation of the conductor assembly 30 basically involves the opposite sequence, however, one must exercise care to insure that the gear segments 66 for the two pivot members 60 and 62 are properly meshed. As a practical matter, the plates 64 and 72 of the two members 60 and 62 will not fit properly into the cutouts 44, that is to say with the face plates 64 flush with the exposed surfaces on the plates 34 of the two leaves, 20 and 22, if the gear segments 66 are incorrectly meshed.

In the operation of the hinge C, the door leaf 20 rotates relative to the door leaf 22 when the door A is moved from closed position to an open position in the door frame B and vice versa. When this occurs, the gear segment 36 on the door leaf 22 rotates over the gear segment 36 on the jamb leaf 20, all while the gear segments 36 remain engaged at their teeth 38. The same holds true with regard to the gear segments 66 on the face plates 64 of the pivot members 60 and 62. The bearing blocks 26 prevent the door leaf 22 from moving downwardly along the jamb leaf 22 under the weight of the door C. In other words, the blocks 26 transfer the weight of the door C from door leaf 22 to the jamb leaf 20.

As the hinge C opens and closes with the door A, the electrical circuits through the hinge remain unaffected. The ribbon wire 82 lies captured between the face plate 64 and backing plate 72 of each pivot member 60 and 62, and between the pivot members 60 and 62 it forms a loop (FIG. 8) which fits behind the meshed gear segments 66 and within the cap 24. In this region it is free to flex to accommodate the opening and closing of the hinge C. The ribbon wire 82 is totally obscured and inaccessible when the conductor assembly 30 is fitted to the two leaves 20 and 22, since as it passes behind the meshed gear segments 66 on face of the hinge A and is obscured on the other face by the cap 24.

Figure 11:
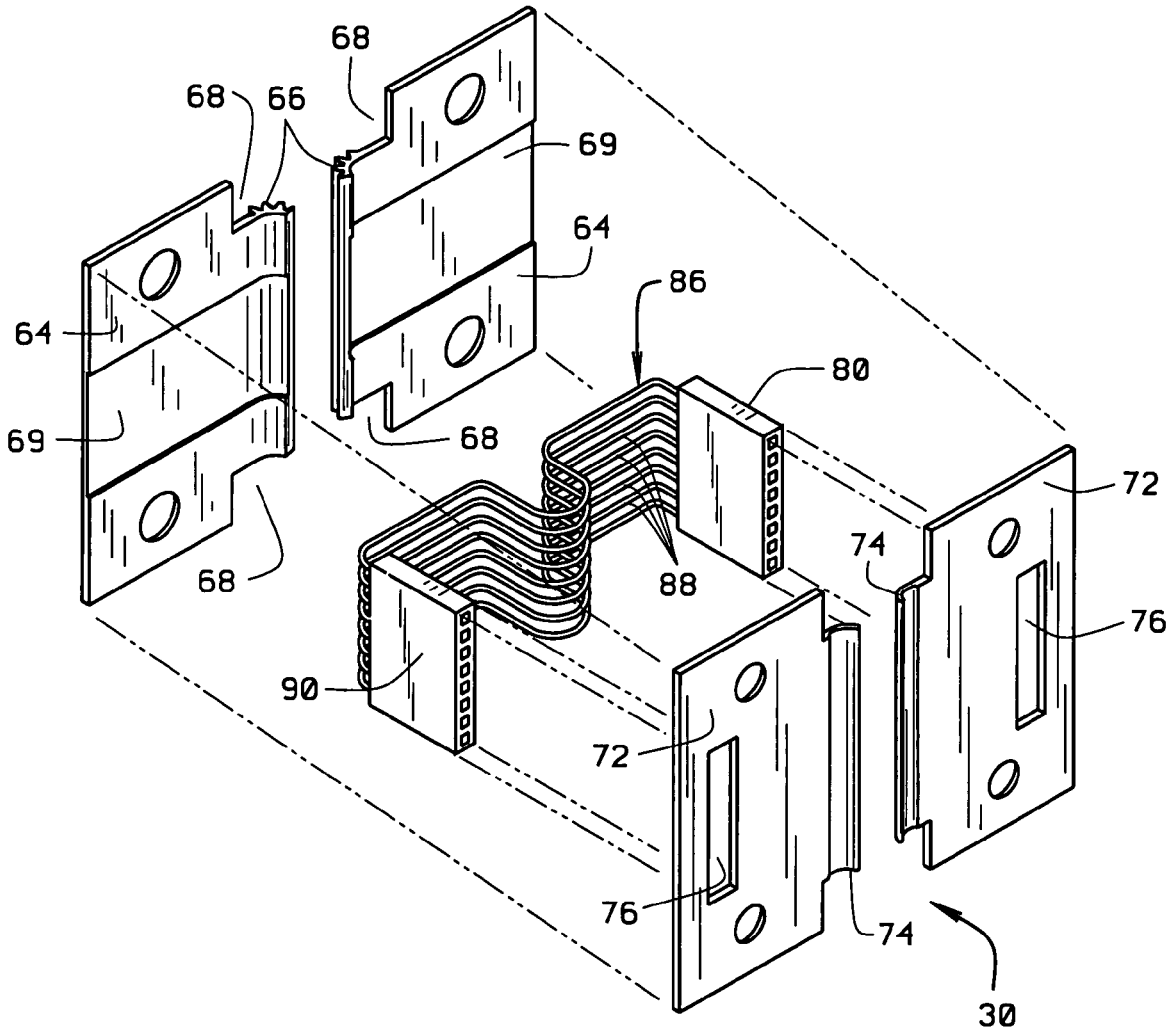
FIG. 11 is an exploded perspective view of the conductor assembly provided with a modified wiring harness.

A modified wiring harness 86 (FIG. 11) is very similar to the harness 80, but in lieu of the ribbon wire 84 with its multiple conductors, the harness 86 has multiple stranded wires 88 extending between two connectors 90 which are received in the elongated apertures 76 of the face plates 64 for the two pivot members 60 and 62. Each wire 88 has its own insulation and is separated from the remaining wires 88. At its ends it is connected to terminals or contacts in the two connectors 90. The individual wires 88 form electrical conductors which pass between the face plates 64 and backing plate 72 of each pivot member 60 and 62 where they lie within the shallow channels 69 of the face plates 64. They emerge from the channels 69 behind the gear segments 66 and between the gear segments 66 of the two pivot members 60 and 62 each wire forms a loop that is contained within the cap 24 of the hinge C.

In lieu of meshing gear segments 66, the pivot members 60 and 62 may have complementary surfaces of other configurations to obscure and render the wire 84 inaccessible. The cutouts 44 in the leaves 20 and 22 should interrupt the gear segments 36 of the leaves 20 and 22, but they need not extend into the plates 34 of the leaves 20 and 22.

What is claimed is:

1. A hinge comprising:

a first leaf having a plate and a gear segment along one side of the plate and also having a cutout in the plate and gear segment, with the cutout interrupting the gear segment;

a second leaf having a plate and a gear segment and also having a cutout in its plate and gear segment, with the cutout interrupting its gear segment, the gear segment of the second leaf meshing the gear segment of the first leaf; the cutout in the second leaf along the gear segment of the second leaf opening toward the cutout in the first leaf along the gear segment in the first leaf;

a cap extended over the gear segments of the first and second leaves to maintain the gear segments meshed, while still allowing one leaf to pivot relative to the other leaf, the cap having a channel-like interior;

a first pivot member in the cutout of the first leaf;

a second pivot member in the cutout of the second leaf, the second member together with the first member obscuring the interior of the cap in the region of the cutouts in the leaves; and an electrical conductor attached to the first and second pivot members and between the pivot members extending though interior of the cap in the region of that interior which is obscured by the cooperating first and second pivot members;

the first and second pivot members and the conductor being removable from the cutouts in the leaves without disassembling the hinge.

2. A hinge according to claim 1 wherein the first and second pivot members have meshing gear segments which align with the meshing gear segments of the leaves, and the meshing gear segments of the pivot members obscure the interior of the cap and the conductor which extends through that interior.

3. A hinge according to claim 2 wherein the conductor is within a ribbon which forms a loop in the interior the cap.

4. A hinge according to claim 2 wherein the conductor is one of several stranded wires.

5. A hinge according to claim 2 wherein each pivot member has a face plate on which the gear segment for the member is located and a backing plate along the face plate; and wherein the conductor extends between the face and backing plates of each pivot member.

6. A hinge according to claim 2 wherein the gear segments on the pivot members are spaced from the gear segments on the leaves to form a pocket; and further comprising a bearing block in the pocket.

7. In combination with a door frame having a hinge jamb and a door, a gear hinge for supporting the door on the door frame, said gear hinge comprising:

a jamb leaf mounted on the hinge jamb and having a gear segment along one of its sides and also a cutout and a pocket, both of which interrupt the gear segment;

a door leaf attached to the door and having a gear segment and a cutout and pocket, both of which interrupt the gear segment, the gear segment of the second leaf meshing with the gear segment of the first leaf, the cutout of the second leaf opening toward the cutout of the first leaf, the pocket of the second leaf opening toward the pocket of the first leaf;

a cap extended over the meshed gear segments to prevent the leaves from separating while enabling the hinge leaf to pivot on the jamb leaf;

a bearing block in the pockets to prevent the door leaf from moving longitudinally on the jamb leaf;

a first pivot member in the cutout of the jamb leaf and having a gear segment that aligns with the gear segment of the jamb leaf;

a second pivot member in the cutout of the door leaf and having a gear segment that aligns with the gear segment of the second leaf and meshes with the gear segment of the first pivot member to obscure and render inaccessible the region of the cap behind the pivot members; and an electrical conductor attached to the first and second pivot members and extending through the interior of the cap where it is obscured by the cap and by the pivot members.

8. The combination according claim 7 wherein the first pivot member is secured to the hinge jamb and the second pivot member is secured to the door.

9. A hinge according to claim 7 wherein the ends of the meshing gear segments on the leaves are spaced from the ends of the meshing gear segments on the pivot members to form the pockets along the gear segments of the leaves and further comprising a bearing block in the pockets.

10. A hinge comprising:

a first leaf having a gear segment and a cutout that opens out of the gear segment;

a second leaf having a gear segment that meshes with the gear segment of the first leaf and a cutout that opens out of its gear segment toward the cutout in the first leaf;

a cap fitted over the gear segments to prevent the gear segments from separating and having an interior;

a first pivot member mounted in the cutout of the first leaf and having a gear segment;

a second pivot member in the cutout of the second leaf and having a gear segment that meshes with the gear segment of the first pivot member to obscure a region of the interior of the cap; and a conductor extending from the first pivot member to the second pivot member through the region of the interior of the cap that is obscured by the meshing gear segments of the first and second pivot members.

11. A hinge according to claim 10 wherein the first and second pivot members have meshing gear segments which obscure the region of the interior of the cap through which the conductor extends.

12. A hinge according to claim 11 wherein the gear segments on the first and second pivot members align with the gear segments on the first and second leaves, but are separated from the gear segments of the leaves by pockets, and wherein a bearing block occupies the pockets, the block extending across the ends of the gear segments at the pockets to prevent the hinge leaves from shifting longitudinally with respect to each other.

13. A hinge according to claim 10 wherein each pivot member includes a face plate and a backing plate; wherein the gear segments for the pivot members are on the face plate: and wherein the conductor passes between the face and backing plates for each pivot member.

14. A hinge according to claim 13 wherein the face plate of the first pivot member is flush with the first hinge leaf and the face plate of the second hinge member is flush with the second leaf.

15. A hinge comprising:

a first leaf having a gear segment that is interrupted;

a second leaf having a gear segment that meshes with the gear segment of the first leaf and is interrupted opposite the location where the gear segment of the first leaf is interrupted;

a cap extended over the gear segments of the first and second leaves to maintain the gear segments meshed, while still allowing one leaf to pivot relative to the other leaf, the cap having a channel-like interior; and a conductor assembly at the location where the gear segments of the hinge leaves are interrupted, the conductor assembly comprising:

a first pivot member mounted in a fixed position with respect to the first hinge leaf where the gear segment of the first hinge leaf is interrupted;

a second pivot member mounted in a fixed position with respect to the second leaf at the location where the gear segment of the second leaf is interrupted;

an electrical conductor extended between the members and through the channel-like interior of the cap;

the first and second pivot members being configured to obscure and render inaccessible the electrical conductor where it passes through the interior of the cap;

the conductor assembly being separable from the hinge leaves without withdrawing the cap from the hinge leaves.

16. A hinge according to claim 15 wherein the gear segments of the hinge leaves are interrupted by cutouts in the hinge leaves and the pivot members are in the cutouts.

17. A hinge according to claim 15 wherein the conductor is an individual stranded wire.

18. A hinge according to claim 15 wherein the conductor is within a ribbon-like wire.

19. A hinge according to claim 15 and further comprising connectors at the ends of the conductor, with the connectors being located behind the pivot members.

* * * * *